US009927199B1

(12) United States Patent
Norris

(10) Patent No.: US 9,927,199 B1
(45) Date of Patent: Mar. 27, 2018

(54) RIFLE ASSMEBLY

(71) Applicant: Richard Mace Norris, Olivehurst, CA (US)

(72) Inventor: Richard Mace Norris, Olivehurst, CA (US)

(73) Assignee: Richard Mace Norris, Olivehurst, CA (US)

( * ) Notice: Subject to any disclaimer, the term of this patent is extended or adjusted under 35 U.S.C. 154(b) by 0 days.

(21) Appl. No.: 15/816,252

(22) Filed: Nov. 17, 2017

(51) Int. Cl.

| | |
|---|---|
| ***F41A 19/00*** | (2006.01) |
| ***F41A 19/16*** | (2006.01) |
| ***F41A 19/10*** | (2006.01) |
| ***F41A 19/11*** | (2006.01) |
| *F41C 23/10* | (2006.01) |
| *F41A 3/66* | (2006.01) |

(52) U.S. Cl.
CPC ..... *F41A 19/16* (2013.01); *F41A 19/10* (2013.01); *F41A 19/11* (2013.01); *F41A 3/66* (2013.01); *F41C 23/10* (2013.01)

(58) Field of Classification Search
CPC ..... F41A 19/09; F41A 19/10; F41A 19/11; F41A 19/16; F41C 7/00
See application file for complete search history.

(56) References Cited

U.S. PATENT DOCUMENTS 1,011,154 A * 12/1911 Cahill ..... F41A 21/08 42/106
1,521,286 A * 12/1924 Fisher ..... F41A 19/10 42/106
2,671,287 A * 3/1954 Hayes ..... F41A 19/09 42/69.01
4,499,683 A * 2/1985 Savioli ..... F41A 19/11 42/69.01
4,514,923 A * 5/1985 Teel ..... F41A 19/09 42/69.01
4,878,305 A * 11/1989 Gabrielidis ..... F41A 19/09 42/118
6,772,548 B1 * 8/2004 Power ..... F41A 19/10 42/69.03
6,957,644 B2 * 10/2005 Simo ..... F41A 19/10 124/31
2004/0035041 A1 * 2/2004 Goko ..... F41A 33/02 42/69.01
2013/0104435 A1 * 5/2013 Fuller ..... F41A 19/10 42/69.01

(Continued)

*Primary Examiner* — Gabriel Klein
(74) *Attorney, Agent, or Firm* — Plager, Schack LLP

(57) ABSTRACT

A rifle assembly for a two-stage trigger includes a rifle arranged with an upper receiver and a lower receiver. A pistol grip is joined to the lower receiver and further has a pistol grip lower edge. A trigger housing further has a trigger housing lower receiver portion immediately adjacent to the lower receiver. The trigger housing lower receiver portion is immediately adjacent to a trigger housing magazine well portion and a trigger housing pistol grip portion. A bow trigger extends through a trigger housing lower receiver portion and into the lower receiver. The bow trigger has a cylindrical housing that is partially filled with a filler. A trigger stub is centrally located in the cylindrical housing. Moving a pressure point up or down on the cylindrical housing effectively changes the rifle from a single stage style fast shooting trigger to a slower shooting long range two stage trigger with a lower trigger pull weight.

4 Claims, 3 Drawing Sheets

(56) References Cited

U.S. PATENT DOCUMENTS

| | | | | |
|---|---|---|---|---|
| 2013/0192116 | A1* | 8/2013 | Elftmann, Jr. ..... | F41A 19/10<br>42/69.01 |
| 2014/0068989 | A1* | 3/2014 | Bender ..... | F41A 19/10<br>42/69.01 |

* cited by examiner

RIFLE ASSMEBLY

BACKGROUND

The embodiments herein relate generally to firearms and firearm accessories.

Prior to embodiments of the disclosed invention, trigger pull weight made operating certain rifles inaccessible for some users. Embodiments of the disclosed invention solve that problem.

SUMMARY

A rifle assembly can be used with a two-stage trigger. The rifle assembly comprises a rifle having an upper receiver rotationally coupled to a lower receiver. A magazine well is joined to the lower receiver and configured to receive a magazine. A pistol grip is joined to the lower receiver and further comprising a pistol grip lower edge. A trigger housing further comprises a trigger housing lower receiver portion immediately adjacent to the lower receiver. The trigger housing lower receiver portion is immediately adjacent to a trigger housing magazine well portion and a trigger housing pistol grip portion. A bow trigger extends through the trigger housing lower receiver portion and into the lower receiver. The bow trigger further comprises a cylindrical housing that is partially filled with a filler. A trigger stub is centrally located in the cylindrical housing. Moving a pressure point up or down on the cylindrical housing effectively changes the rifle from a single stage style fast shooting trigger to a slower shooting long range two stage trigger with a lower trigger pull weight.

A trigger guard includes a trigger guard magazine well portion that is rotationally coupled to the trigger housing magazine well portion. A trigger guard intermediate portion is joined to the trigger guard magazine well portion. A trigger guard pistol grip portion is joined to the trigger guard intermediate portion and the pistol grip lower edge.

A trigger guard magazine well portion axis is arranged on the trigger guard magazine well portion. A trigger guard intermediate portion axis is arranged on the trigger guard intermediate portion. A trigger guard pistol grip portion axis is arranged on the trigger guard pistol grip portion. A first angle is measured from clockwise from the trigger guard magazine well portion axis to the trigger guard intermediate portion axis. A second angle is measured clockwise from the trigger guard intermediate portion axis to the trigger guard pistol grip portion axis. The first angle can be at least 110 degrees and no more than 160 degrees. The second angle can be at least 90 degrees but no more than 145 degrees.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
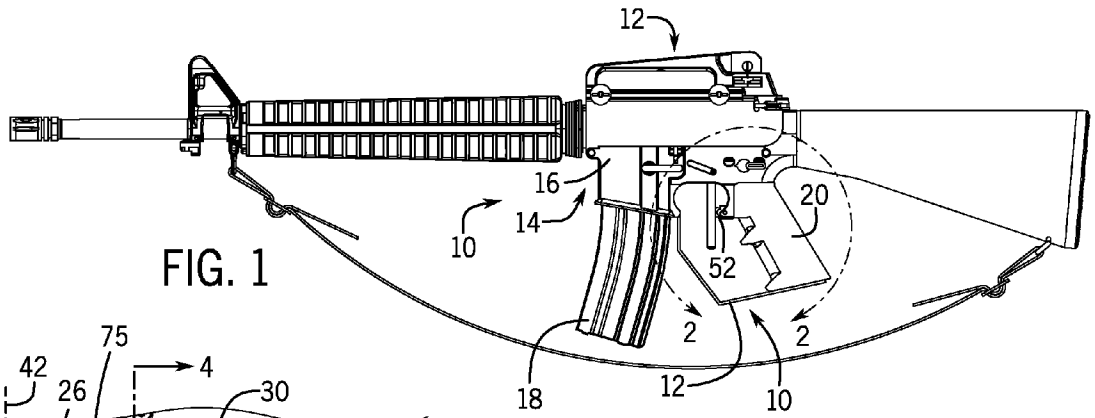
FIG. 1 shows a side perspective view of one embodiment of the present invention shown in use.
Figure 3:
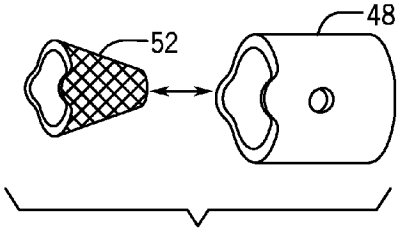
FIG. 3 shows a detail side assembly view of one embodiment of the tube and cone components of present invention.
Figure 2:
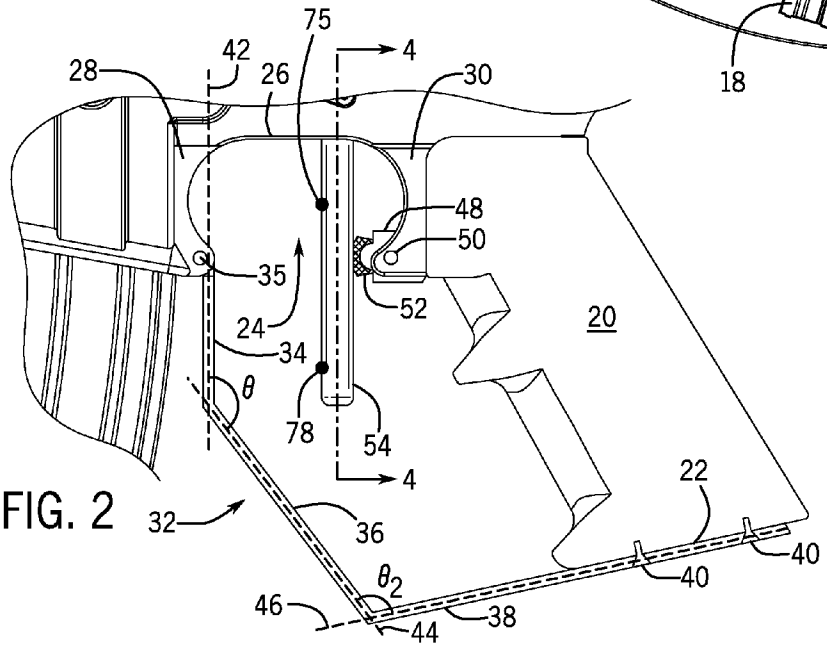
FIG. 2 shows a detail side view of one embodiment of the present invention shown in use.
Figure 4:
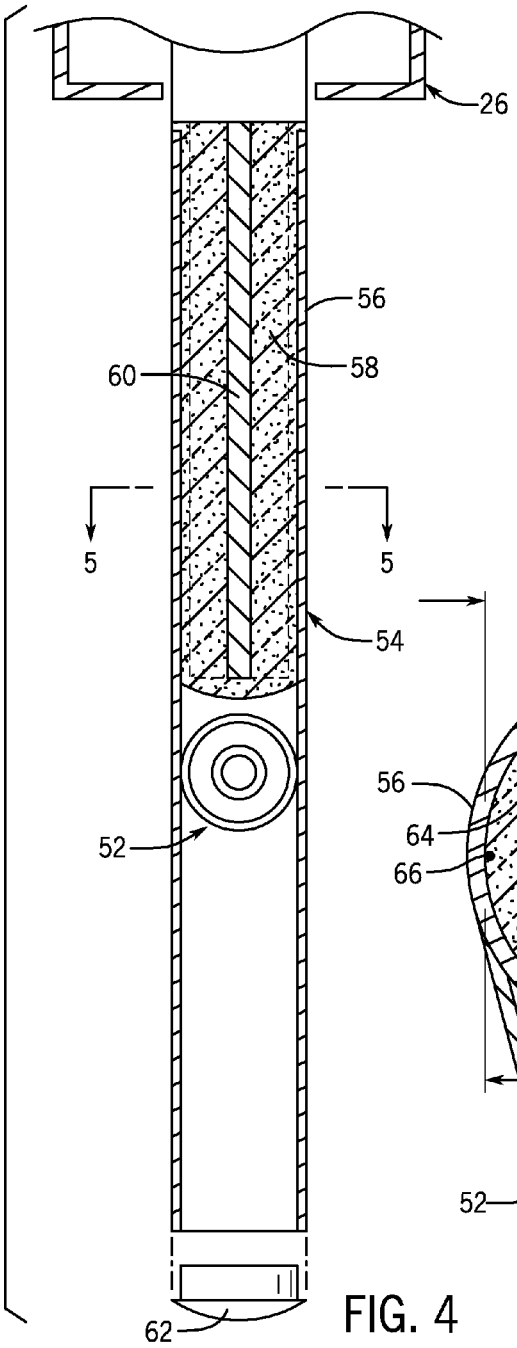
FIG. 4 shows a section view of one embodiment of the present invention taken along line 4-4 in FIG. 2.

By way of example, and referring to FIG. 1, one embodiment of the present system comprises a rifle 10. Rifle 10 further comprises an upper receiver 12 rotationally coupled to a lower receiver 14. The lower receiver is joined to a magazine well 16 that is configured to receive a magazine 18. The lower receiver 14 is further connected to a pistol grip 20. The pistol grip 20 further comprises a pistol grip lower edge 22 which is flat.

A trigger housing 24 further comprises a trigger housing lower receiver portion 26. The trigger housing lower receiver portion 26 is immediately adjacent to a trigger housing magazine well portion 28 and a trigger housing pistol grip portion 30.

A trigger guard 32 further comprises a trigger guard magazine well portion 34 that is rotationally coupled to the trigger housing magazine well portion 28 with a first fastener 35. The trigger guard magazine well portion 34 is joined to a trigger guard intermediate portion 36. The trigger guard intermediate portion 36 is joined to a trigger guard pistol grip portion 38. The trigger guard pistol grip portion 38 is joined to the pistol grip lower edge 22 with fasteners 40. The trigger guard magazine well portion 34 is arranged on a trigger guard magazine well portion axis 42. The trigger guard intermediate portion 36 is arranged on a trigger guard intermediate portion axis 44. The trigger guard pistol grip portion 38 is arranged on a trigger guard pistol grip portion axis 46. A first angle θ1 is measured from clockwise from the trigger guard magazine well portion axis 42 to the trigger guard intermediate portion axis 44. A second angle θ2 is measured clockwise from the trigger guard intermediate portion axis 44 to the trigger guard pistol grip portion axis 46. In some embodiments the first angle θ1 can be at least 110 degrees and no more than 160 degrees. In some embodiments the second angle θ2 can be at least 90 degrees but no more than 145 degrees.

A tube 48 is mechanically coupled to the trigger housing pistol grip portion 30. The tube 48 is fixed to the trigger housing pistol grip portion 30 with a pin 50. A cone 52 is fixed to a bow trigger 54 with epoxy. The cone 52 can be a hollow plastic cone, which is colored with caution orange to indicate whether the rifle 10 is charged or whether the rifle 10 is safe or ready for use. The shading in the figures indicates the caution orange color.

The cone 52 moves in and out of tube 48 depending on weather the rifle is charged, that is, whether a round is in the chamber, or not. Tube 48 is attached to the rifle at the hole left by the removal of the old stock trigger guard with a rolled pin. The cone 52 does not connect to the tube 48.

When the cone 52 is rotated outward it is immediately adjacent to a bow trigger 54. The bow trigger 54 extends through the trigger housing lower receiver portion 26 and further comprises a cylindrical housing 56 that is partially filled with a filler 58. Centrally located in the cylindrical housing 56 is a trigger stub 60. The trigger stub 60 can be a t-shaped flat structural steel flat bow trigger stub. The cylindrical housing 56 can be made of carbon fiber and capped with a cap 62. The filler 58 can be a Room-Temperature-Vulcanization (RTV) silicone filler. After the filler cures, it becomes an isolating filter that removes the unwanted trigger seer grind to make the trigger pull very smooth. The isolating filter is critical because the longer trigger bow would magnify the seer grind to the shooter. Any seer grind is bad for accuracy and performance.

Figure 5:
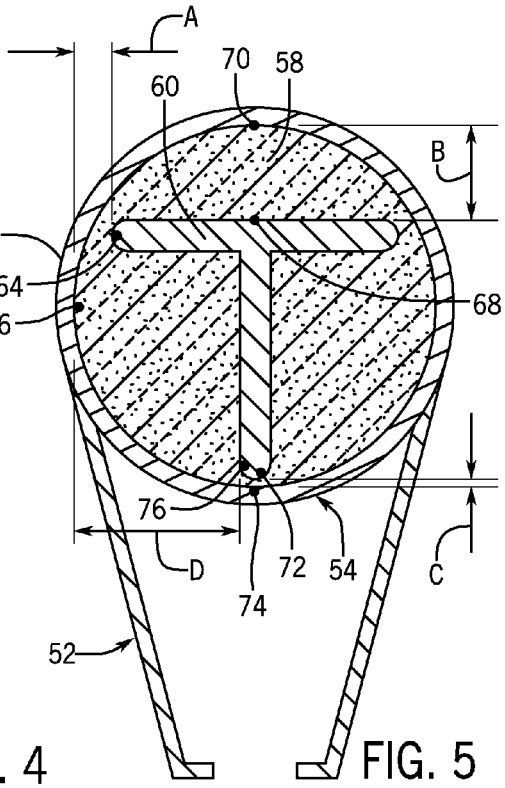
FIG. 5 shows a section view of one embodiment of the present invention taken along line 5-5 in FIG. 4.
Figure 6:
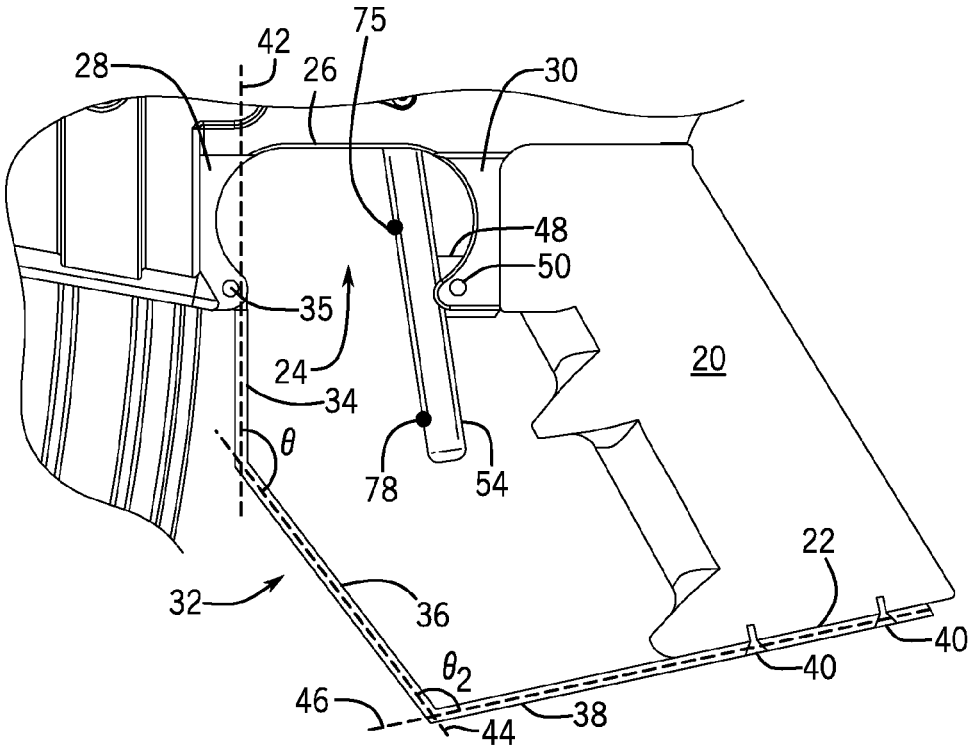
FIG. 6 shows a detail side view of one embodiment of the present invention shown in use.

As shown in FIG. 5, a first distance A can be measured from an outside point 64 on the trigger stub 60 linearly to a distal point 66 on an inside of the cylindrical housing 56. A second distance B can be measured from a top point 68 on the trigger stub 60 linearly to a top inside point on an inside of the cylindrical housing 56. A third distance C can be measured from a bottom point 72 on the trigger stub 60 linearly to a bottom inside point 74 on an inside of the cylindrical housing 56. A fourth distance D can be measured from a sidewall point 76 on the trigger stub 60 linearly to the distal point 66 on an inside of the cylindrical housing 56. These distances can vary greatly.

To use the device, a user can slide a finger up or down on the cylindrical housing 56 to effectively change from a single stage style, fast shooting trigger at a first pressure point 75 to a slower shooting long range two stage trigger with a lower trigger pull weight at a second pressure point 78. As used in this application the point of finger squeeze pressure on the cylindrical housing is called a "pressure point." Of course, pressure need not be applied by a human user as operation is identical with a robotic user. A stock trigger with a seven pound pull weight at the first pressure point 75 would receive a reduction of the trigger pull weight by 65% at the second pressure point 78 and increase the travel distance of the trigger pull by about 150%.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A rifle assembly for a two-stage trigger; the rifle assembly comprising:

a rifle having an upper receiver rotationally coupled to a lower receiver;

a magazine well, joined to the lower receiver and configured to receive a magazine;

a pistol grip, joined to the lower receiver and further comprising a pistol grip lower edge;

a trigger housing further comprising a trigger housing lower receiver portion immediately adjacent to the lower receiver; wherein the trigger housing lower receiver portion is immediately adjacent to a trigger housing magazine well portion and a trigger housing pistol grip portion;

a bow trigger, extending through the trigger housing lower receiver portion and into the lower receiver; the bow trigger further comprising:

a cylindrical housing that is partially filled with a filler;

a trigger stub, centrally located in the cylindrical housing;

an isolating filter partially filling the cylindrical housing around the trigger stub;

wherein moving a pressure point from up to down on the cylindrical housing effectively changes the bow trigger from a single stage relatively faster shooting trigger to a relatively slower shooting two stage trigger with a relatively lower trigger pull weight.

2. The rifle assembly of claim 1, further comprising:

a trigger guard further comprising:

a trigger guard magazine well portion that is rotationally coupled to the trigger housing magazine well portion;

a trigger guard intermediate portion, joined to the trigger guard magazine well portion; and a trigger guard pistol grip portion, joined to the trigger guard intermediate portion and the pistol grip lower edge.

3. The rifle assembly of claim 2, further comprising:

a trigger guard magazine well portion axis, arranged on the trigger guard magazine well portion;

a trigger guard intermediate portion axis, arranged on the trigger guard intermediate portion;

a trigger guard pistol grip portion axis, arranged on the trigger guard pistol grip portion;

a first angle, measured from clockwise from the trigger guard magazine well portion axis to the trigger guard intermediate portion axis; and a second angle, measured clockwise from the trigger guard intermediate portion axis to the trigger guard pistol grip portion axis.

4. The rifle assembly of claim 3, wherein the first angle is at least 110 degrees and no more than 160 degrees; and wherein the second angle is at least 90 degrees but no more than 145 degrees.

* * * * *